US007735576B2

(12) United States Patent
Wimmer

(10) Patent No.: US 7,735,576 B2
(45) Date of Patent: Jun. 15, 2010

(54) DEVICE FOR GUIDING AND TENSIONING SUPPLY LINES

(76) Inventor: Alois Wimmer, Gitzen 85, 5322 Hof bei Salzburg (AT)

( * ) Notice: Subject to any disclaimer, the term of this patent is extended or adjusted under 35 U.S.C. 154(b) by 506 days.

(21) Appl. No.: 11/718,051

(22) PCT Filed: Oct. 28, 2005

(86) PCT No.: PCT/AT2005/000428

§ 371 (c)(1),
(2), (4) Date: Apr. 26, 2007

(87) PCT Pub. No.: WO2006/045134

PCT Pub. Date: May 4, 2006

(65) Prior Publication Data

US 2009/0134261 A1 May 28, 2009

(30) Foreign Application Priority Data

Oct. 28, 2004 (AT) ..... A 1812/2004

(51) Int. Cl.
*B23Q 5/02* (2006.01)

(52) U.S. Cl. ..... 173/141; 173/147; 173/152

(58) Field of Classification Search ..... 173/141, 173/147, 43, 152; 242/615, 615.1, 615.2, 242/615.3, 615.4; 226/196.1
See application file for complete search history.

(56) References Cited

U.S. PATENT DOCUMENTS

| | | | | |
|---|---|---|---|---|
| 2,788,194 | A * | 4/1957 | Hale | 173/147 |
| 2,799,186 | A | 7/1957 | Siekmann et al. | |
| 3,162,253 | A * | 12/1964 | Curtis | 173/147 |
| 3,446,295 | A * | 5/1969 | Leven | 173/147 |
| 3,508,619 | A * | 4/1970 | Huffman | 173/147 |
| 3,744,575 | A | 7/1973 | Strömmes | |
| 3,973,634 | A | 8/1976 | Persson et al. | |
| 5,050,688 | A | 9/1991 | Patterson | |
| 6,015,112 | A | 1/2000 | Häkkinen et al. | |

FOREIGN PATENT DOCUMENTS

| | | |
|---|---|---|
| DE | 1 474 977 | 3/1971 |
| DE | 24 19 470 | 11/1975 |
| GB | 1 210 320 | 10/1970 |
| GB | 1 249 526 | 10/1971 |

* cited by examiner

*Primary Examiner*—Rinaldi I. Rada
*Assistant Examiner*—Nathaniel Chukwurah
(74) *Attorney, Agent, or Firm*—Henry M. Feiereisen; Ursula B. Day

(57) ABSTRACT

In a device for guiding and tensioning supply lines for working tools movable along a straight guide, e.g. supply lines of a hydraulic hammer drill on an advance mounting, the advance of the working tool is implemented by means of a revolving transport chain driven by a sprocket wheel, and the supply line(s) are guided between the connections on the fixed guide and the connections on the working tool by a tension roller which causes a deflection about 180° and is movable in advance direction downstream the working tool conjointly therewith in the same direction but at half the advance speed, wherein the tension roller is slidably guided on the guide for the working tool transversely to its rotation axis, and wherein a pinion engages the transport chain for driving the movement of the tension roller and interacts with a fixed chain on the opposite side. To realize a controlled movement of the tension roller in both direction, a further transport wheel (14) for the advancement of the tension roller (8) is mounted onto the shaft (23) of the pinion (22) that engages the transport chain (4), for interaction with a fixed chain, a rack, a fixed traction rope, or the like.

7 Claims, 5 Drawing Sheets

6
4
4
7
11
1
2
3
10
8
13
9
12
5

6
4
7
11
1
10
2
3
10
9
8
5

1
4
2
3
10
V
V
20
16
14
13
15
8
9
12
5

4
1
3
2
10
9
4
21
8
8'
17
18
5
19

10
10
24
16
14
15
9
12
20
26
18
21
25
5

DEVICE FOR GUIDING AND TENSIONING SUPPLY LINES

BACKGROUND OF THE INVENTION

The invention relates to a device for guiding and tensioning supply lines for working tools movable along a straight guide, e.g. supply lines of a hydraulic hammer drill on an advance mounting, wherein the advance of the working tool is implemented by means of a revolving transport chain driven by a sprocket wheel, and the supply line(s) are guided between the connections on the fixed guide and the connections on the working tool via a tension roller which causes a deflection by about 180° and is movable in advance direction downstream the working tool conjointly therewith in the same direction but at half the advance speed, wherein the tension roller is slidably guided transversely to its rotation axis on the guide for the working tool, and wherein the drive for the movement of the tension roller includes a pinion which engages the transport chain and interacts with a fixed chain on the opposite side.

According to a known design, the tension roller is guided via a tackle of the block-and-pulley type with loose rope pulley, wherein the loose pulley controls the movement of the tension roller. The drawback of such a design is the susceptibility of tackles to fail, in particular when subjected to rough handling in the area of such tools. Moreover, a tackle control can be actively controlled only in one direction whereas means for retraction and maintaining the tackle taut must be provided in the other direction.

The afore-described design is disclosed in U.S. Pat. No. 3,973,634, with the pinion, which engages the transport chain, engaging with its region that is opposite to the area of engagement in the transport chain in the fixed chain so that only few engaging teeth of the pinion are available to absorb the entire load.

SUMMARY OF THE INVENTION

The invention is based on the object to provide a device of the afore-stated type, by which the tension roller can be actively controlled for movement in both directions, wherein the drive should be arranged in a substantially protected environment and should be less prone to fail.

This object is attained in accordance with the present invention by mounting a further transport wheel for advancing the tension roller onto the shaft of the pinion that engages the transport chain, for interaction with a fixed chain, rack, fixed traction rope, or the like. As a result, the tension roller is forced to synchronously move along the guide for the working tool, with this type of drive being less prone to fail.

The fixed chain, rack, fixed traction rope, or the like, may advantageously be mounted elastically yielding in the advance direction so that changes as a result of wear or heat expansion or the like can be compensated. The tension roller may hereby be rotatably supported on a carriage which also rotatably supports the shaft with the pinion and the transport wheel, wherein deflection rollers are supported on the carriage in a same plane as the transport wheel for respectively guiding the fixed chain or the fixed traction rope upstream and downstream of the transport wheel. This ensures a continuously reliable engagement and reliable looping of the transport wheel by the fixed chain or the fixed traction rope.

In order to keep the rolling resistance along the tension roller as low as possible, the tension roller in a manner known per se may be formed by several rolls which are arranged along a circle defined by a center point coinciding with the axis of the tension roller and which are defined by rotation axes in parallel relationship to the rotation axis of the tension roller, wherein counter rolls may be associated to the outer circumference of the tension roller and the rolls. As a result, the supply lines or the supply hoses bear only along the rollers upon the tension roller, wherein the rolls as a consequence of their rotatability compensate the rolling resistance or a possible relative movement between tension roller and supply hoses, wherein a detachment of the supply lines from the tension roller or the rolls of the tension roller is prevented. In addition, the tension roller or rolls and/or counter rolls may be provided on the outer surface area with wrap-around grooves for the at least partial acceptance of the supply lines, thus also preventing a lateral dislocation of the supply lines on the tension roller.

BRIEF DESCRIPTION OF THE DRAWING

An exemplified embodiment of the connection device is shown in the drawing.

DETAILED DESCRIPTION OF PREFERRED EMBODIMENTS

Figure 1:
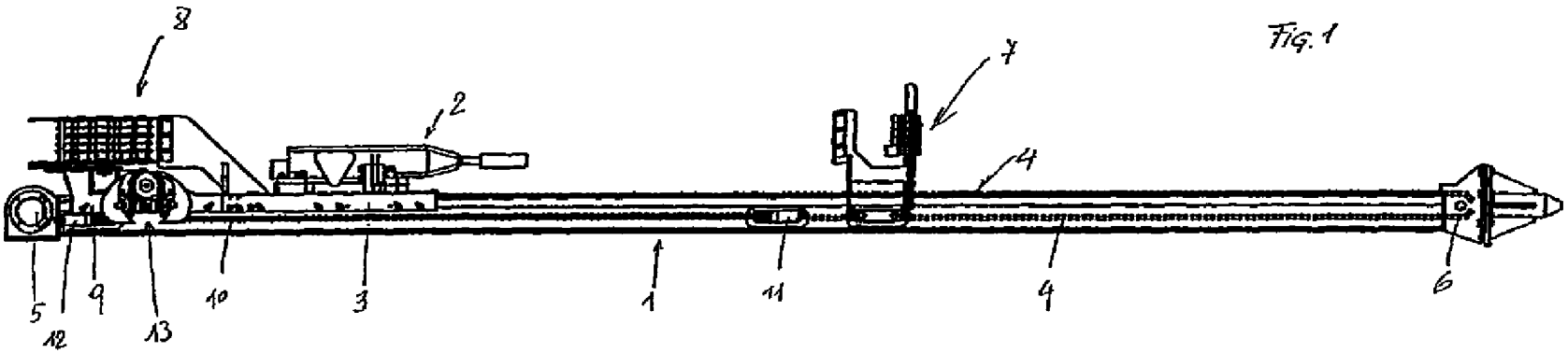
FIG. 1 shows a side view of the entire drilling device.
Figure 2:
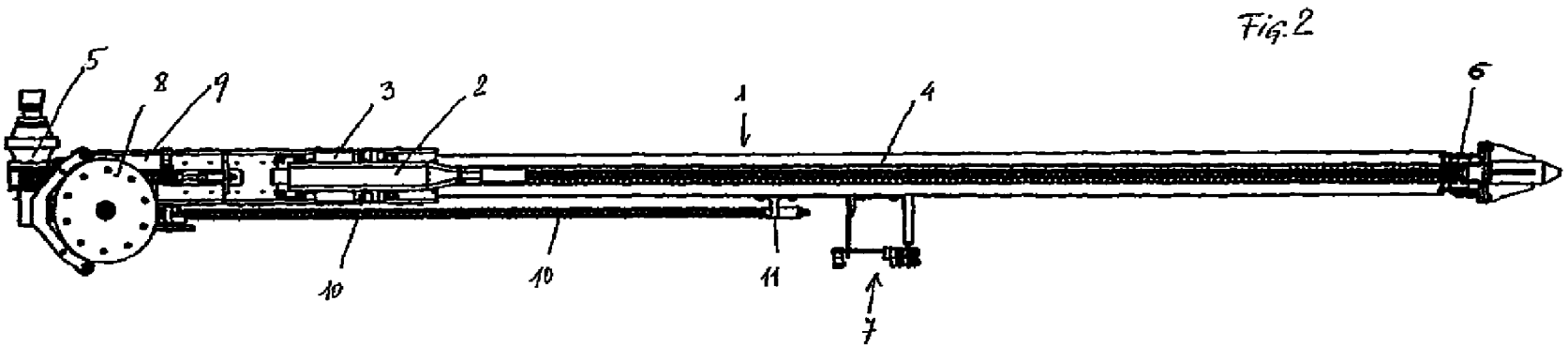
FIG. 2 shows a top view upon the construction according to FIG. 1.
Figure 3:
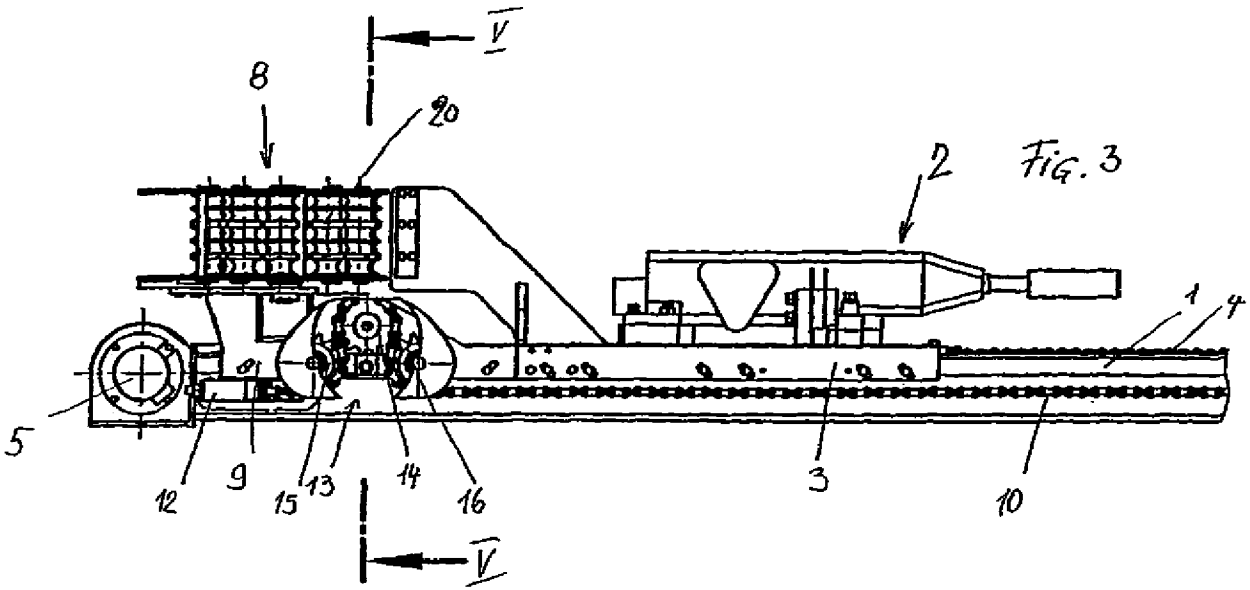
FIG. 3 is a side view of the part of the advance mounting carrying the tension roller as well as the tool advancement mechanism.
Figure 4:
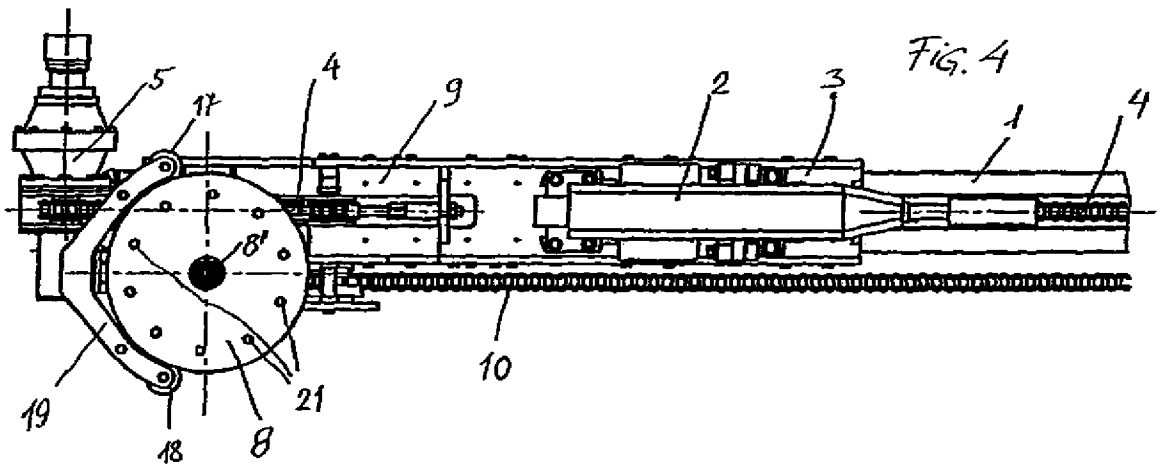
FIG. 4 is a top view of the part of the subject matter of the invention depicted in FIG. 3.
Figure 5:
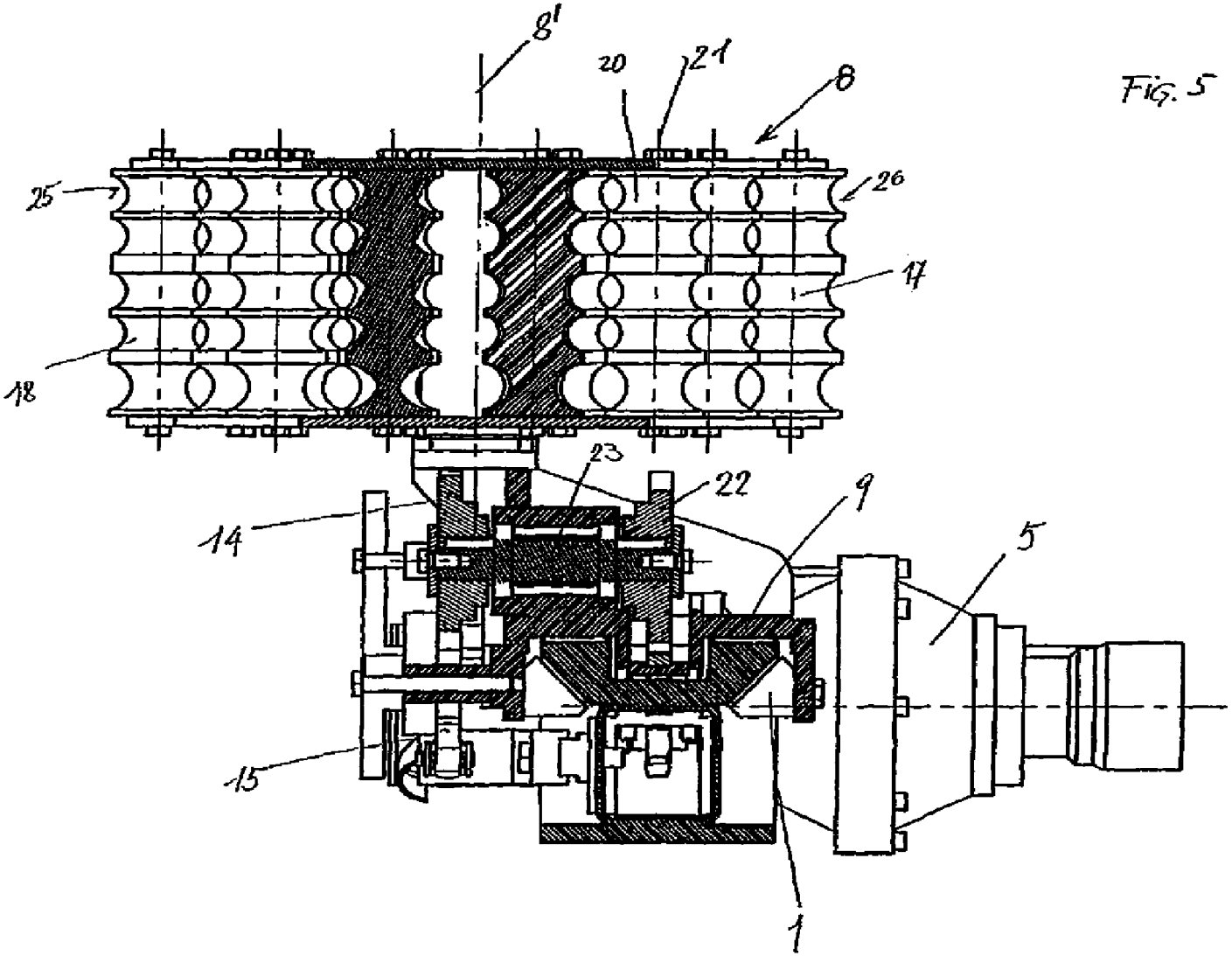
FIG. 5 shows, on an enlarged scale, a section along line V-V in FIG. 3.

1 designates a guide along which the working tool 2 is movable via a carriage 3. This movement is realized by a transport chain 4 which is configured as a revolving chain having ends secured to the carriage 3. This revolving transport chain is looped about a drive 5 with a pinion and a deflection roller 6. The guide 1 can be attached to an excavator arm via a conventional suspension.

Provided between a mounting 7 and the working tool 2 are supply lines which are not shown here and provided for supply of hydraulic liquid, energy, and the like to the working tool. Control lines may also be provided between the mounting 7 and the working tool 2. Provided on this mounting are the supply feeds from the excavator after attachment to an excavator boom. These lines are prevented from sagging by a tension roller 8 about which the supply lines are routed. As the tension roller 8 acts like a loose pulley on a tackle, when the working tool advances, it must be moved in synchronism with the working tool in a same direction at half the advance speed of the working tool.

The tension roller 8 is hereby secured to a carriage 9 for rotation about a shaft 8', wherein the carriage 9 is movable on the same guide 1 as the carriage 3 for the working tool 2. A fixed chain 10 is provided for advancing the carriage 9 with the tension roller 8 and is fixedly suspended to the guide 1 via suspensions 11 and 12. Springs are provided in the suspensions 11, 12 in order to be able to compensate a possible play and also to allow an elastic tensioning of the supply lines via the springs. In addition, the springs act also as damper during advance of the carriage, in particular during return to the upper end position (stop).

The advance of the carriage 9 is realized by an advancement device 13 having a driving pinion 14 about which the fixed chain 10 is wrapped by means of the deflection rollers 15, 16 at an angle of wrap of above 180°.

The drive of the driving pinion 14 is realized by a pinion 22 provided on a shaft 23 and engaging the transport chain 4. The driveshaft 23 is hereby rotatably supported in the carriage 9, wherein the driving pinion 14 and the pinion 22 are in fixed rotative engagement on the shaft 23.

In the present exemplified embodiment, the tension roller 8 is formed by a plurality of rolls 30 defined by axes 21 extending in parallel to the axis 8' of the tension roller 8, wherein the rolls 20 can freely rotate on these axes 21. Associated to the outer circumference of the tension roller 8, as defined by the rolls 20, are counter rolls 17, 18 which area also mounted on the carriage 9 via a common carrier 19. The counter rolls 17, 18 are also freely rotatable.

The rolls 20 of the tension roller 8 as well as the counter rolls 17, 18 have an outer circumference formed with grooves which are labeled with 25 with respect to the rolls 20 and with 26 with respect to the counter rolls. These grooves 25, 26 are so dimensioned as to be able to jointly receive the respective supply lines, whereby the groove configuration prevents a lateral slippage of the supply lines from the rolls 20 or the tension roller 8, even when the supply lines sag for any reason.

Figure 6:
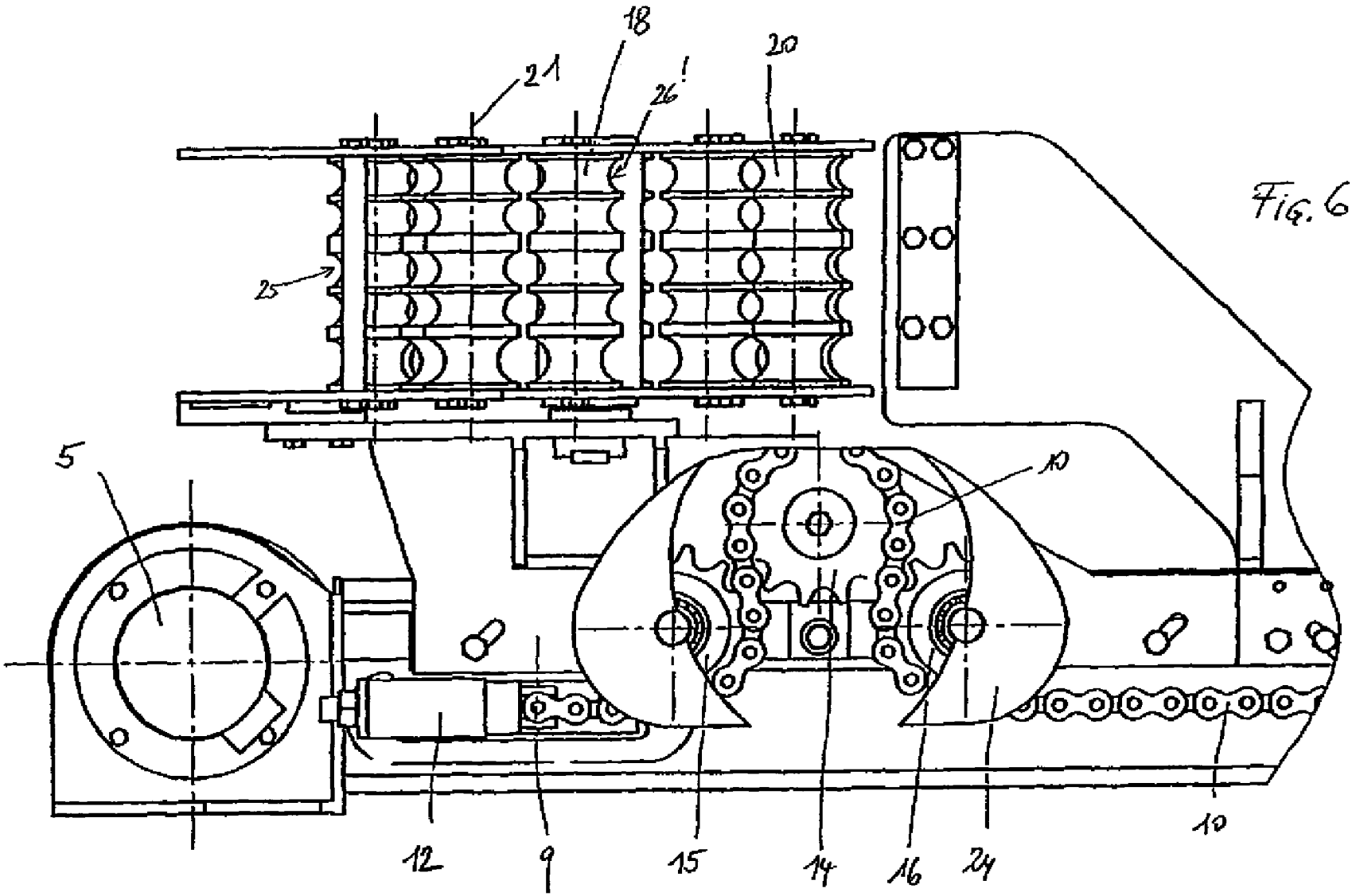
FIG. 6 shows, on an enlarged scale, a side view of the tension roller including drive of the advance of the tension roller.
Figure 9:
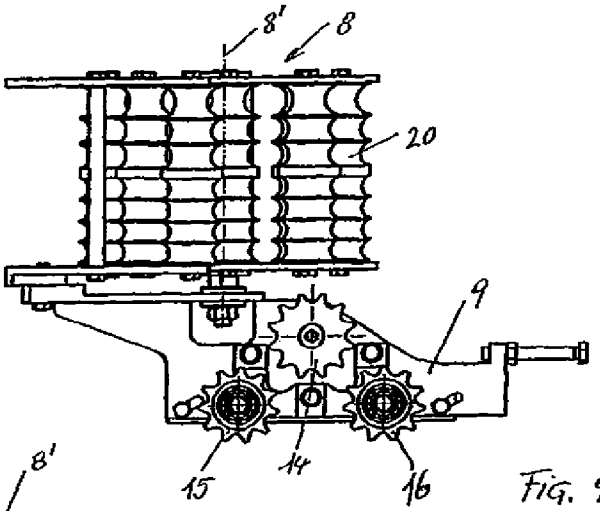
FIG. 9 depicts a side view thereof.
Figure 8:
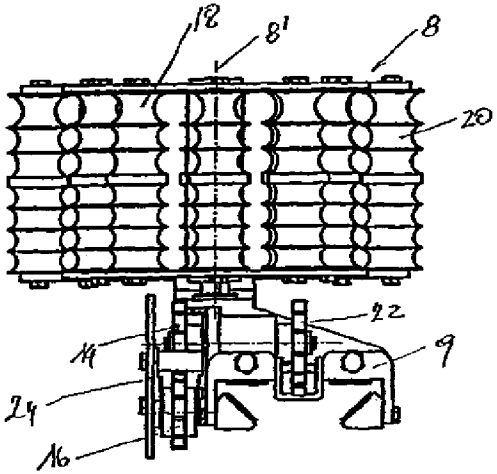
FIG. 8 is a front view of the component illustrated in FIG. 7.
Figure 7:
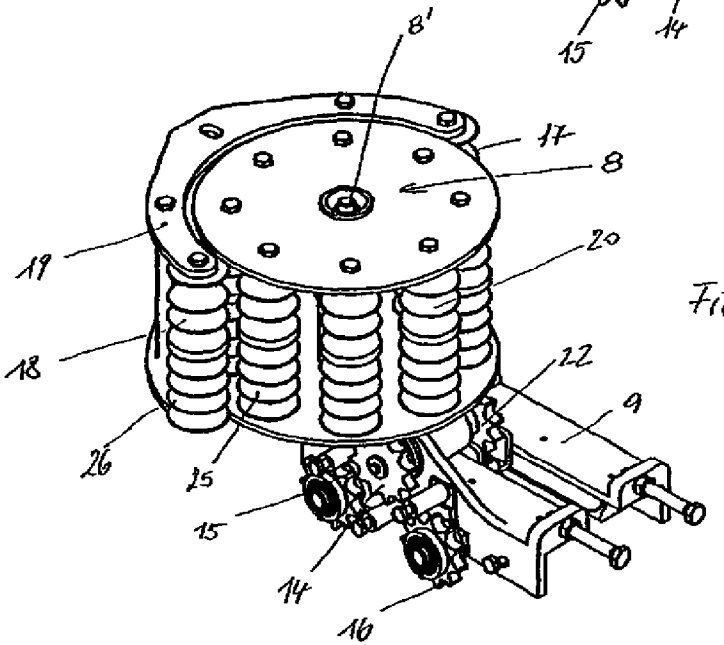
FIG. 7 shows a graphical representation of the carriage carrying the tension roller as well as the pertaining drive.

The drive of the carriage 9 is implemented in such a manner that an advance of the working tool 2 in the direction towards the deflection roller 6 of the transport chain 4 causes the transport chain to be pulled about the drive 5 such that the upper strand of the transport chain 4 draws the carriage 3 in the direction towards the deflection roller 6. As a result of this movement of the transport chain 4 along the guide 1, the pinion 22 which engages the transport chain 4 from atop turns about its axis 23 such that the driving pinion 14 turns counterclockwise as viewed in FIG. 6. This entire drive between transport chain 4, pinion 22, shaft 23, driving pinion 14, and fixed chain 10 acts virtually as "loose pulley" of a tackle so that the carriage 9 advances at half the speed of the advance of the carriage 3 for the working tool 2. Thus, the tension roller 8, which is secured to the carriage 9, forms the "loose roller" for the supply lines.

When the working tool 2 moves backwards, the drive of the carriage 9 runs in opposite direction, i.e. the carriage 9 returns to its initial position at half the speed of the carriage 3.

What is claimed is:

1. A device for guiding and tensioning a supply line for a working tool, comprising:

a revolving transport chain for moving the working tool along a straight guide;

a tension roller about which the supply line is looped for deflecting the supply line by 180°, said tension roller being movable in an advance direction downstream of the working tool conjointly therewith in a same direction but at half an advance speed of the working tool, said tension roller defining a rotation axis and slidably guided transversely to the rotation axis on the guide for the working tool, wherein the tension roller is formed by several rolls which are arranged along a circle defined by a center point coinciding with the rotation axis of the tension roller and which are defined by rotation axes in parallel relationship to the rotation axis of the tension roller;

a drive mechanism for moving the tension roller, said drive including a pinion which is mounted on a shaft and which has one zone engaging the transport chain and another opposite zone interacting with a fixed force-transmitting member, and a transport wheel which is mounted onto the shaft of the pinion for interaction with the force-transmitting member; and counter rolls interacting with an outer circumference of the tension roller.

2. The device of claim 1, wherein the working tool is a hydraulic hammer drill on an advance mounting.

3. The device of claim 1, wherein the drive mechanism includes a sprocket wheel for operating the transport chain.

4. The device of claim 1, wherein the force-transmitting member is an element selected from the group consisting of fixed chain, rack, and fixed traction rope.

5. The device of claim 1, wherein the force-transmitting member is secured to the guide in an elastically yielding manner in the advance direction.

6. The device of claim 1, wherein the drive mechanism includes a carriage for rotatably supporting the tension roller and rotatably supporting the shaft with the pinion and the transport wheel, wherein the drive mechanism includes deflection rollers which are supported on the carriage in a same plane as the transport wheel for respectively guiding the force-transmitting member upstream and downstream of the transport wheel.

7. The device of claim 1, wherein at least one element selected from the group consisting of the tension roller and the counter rolls have an outer surface area formed with wrap-around grooves for at least partially accepting the supply line.

* * * * *